United States Patent [19]

Shimizu et al.

[11] Patent Number: 4,560,604

[45] Date of Patent: Dec. 24, 1985

[54] METHOD OF FLOCKING TREATMENT

[75] Inventors: Goro Shimizu; Yosuke Kitagawa, both of Ohtsu, Japan

[73] Assignee: Matsui Shikiso Chemical Co., Ltd., Japan

[21] Appl. No.: 643,054

[22] Filed: Aug. 22, 1984

[51] Int. Cl.[4] ..... B05D 1/06; B05D 1/14

[52] U.S. Cl. ..... 428/87; 428/90; 428/95; 428/97; 428/240; 428/245; 428/321.5; 428/913; 427/26; 427/412; 427/412.1

[58] Field of Search ..... 428/87, 90, 95, 97, 428/240, 245, 321.5, 913; 427/26, 412, 412.1

[56] References Cited

U.S. PATENT DOCUMENTS 3,585,381 6/1971 Hodson et al. ..... 428/321.5
4,122,219 10/1978 Fickeisen et al. ..... 427/26
4,301,054 11/1981 Buirley et al. ..... 428/321.5

*Primary Examiner*—Richard Bueker
*Attorney, Agent, or Firm*—McGlew and Tuttle

[57] ABSTRACT

A method characterized by entirely or partially coating a shaped material of synthetic resin or fibers with an adhesive having incorporated therein a thermally color-changeable particulate material which comprises three components enclosed or encapsulated in a high-molecular-weight compound, the three components being an electron donating chromogenic substance, an electron accepting substance corresponding to the chromogenic substance and a solvent having a boiling point of at least 150° C. and selected from among alcohols, amides, esters and azomethines; and electrostatically flocking the adhesive layer with colored or colorless short fibers. The treated material is useful for making stuffed toys or dolls.

2 Claims, No Drawings

METHOD OF FLOCKING TREATMENT

The present invention relates to a novel method of flocking treatment for preparing treated materials the color of which is reversibly changeable with variations of ambient temperature.

It is well known to prepare temperature indicating articles by directly or otherwise printing a desired pattern on a cloth, paper or the like with a composition containing a temperature-sensitive color-changeable material, or by applying an adhesive to the rear side of such a print and affixing the print to an object. However, the changeable color of the temperature indicating article always appears two-dimensional, is simple and lacks a three-dimensional appearance. Moreover, mercury salt, cobalt salt, etc. serving as color change materials do not have selectivity in respect of color and temperature but undergo a color change only at a high temperature and are low in durability. Because of these drawbacks, the temperature indicating articles find only limited industrial use, for example, for sensing the temperature of heat developing portions.

In view of such drawbacks of conventional color-changeable articles, we have carried out extensive research to obtain an article the color of which is changeable at an optionally selected temperature, appears three-dimensional as distinct from the neighboring articles and is outstanding in durability. As a result, we prepared a color-changeable shaped article of synthetic resin or fibers by entirely or partially coating the surface of the article with an adhesive having incorporated therein a thermally color-changeable particulate material which comprises three components enclosed in a high-molecular-weight compound, the three components being an electron donating chromogenic substance, an electron accepting substance corresponding to the chromogenic substance and a solvent having a boiling point of at least 150° C. and selected from among alcohols, amides, esters and azomethines, and electrostatically flocking the resulting adhesive layer with colored or colorless short fibers. We have found that the shaped article has a changeable color which appears remarkably three-dimensional, exhibits high colorfastness because the thermally color-changeable particulate material is protected by the flock layer,and is useful for a wide variety of applications. Thus, the present invention has been accomplished.

More specifically, the present invention provides a method which is characterized by entirely or partially coating a surface of a shaped material of a synthetic resin or fibers with an adhesive having incorporated therein a thermally color-changeable particulate material, the particulate material comprising three components enclosed in a high-molecular-weight compound, the three components being an electron donating chromogenic substance, an electron accepting substance corresponding to the chromogenic substance and a solvent having a boiling point of at least 150° C. and selected from the group consisting of alcohols, amides, esters and azomethines; and electrostatically flocking the resulting adhesive layer with colored or colorless short fibers.

Examples of useful synthetic resin shaped materials, one type of materials to be flocked by the present method, are sheets, foamed bodies, three-dimensional shaped bodies and surface-treated articles of thermoplastic resins such as polyolefin resin, vinyl chloride resin, vinyl acetate resin, polybutyral resin, polyacrylate resin, polyamide resin, polyester resin, polycarbonate resin, polyphenylether resin, polysulfone resin and polyurethane resin, copolymers of such resins, and thermosetting resins such as melamine resin, urea resin, epoxy resin and unsaturated polyester resin. Examples of useful fiber shaped materials, another type of materials to be flocked by the present method, are yarns, woven fabrics, knitted fabrics, mixed or blended yarn woven fabrics and blended yarn knitted fabrics of polyester, nylon, polyacrylic, vinylon, acetate, rayon, silk, wool, cotton, hemp, cuprammonium rayon and like fibers. Also useful are mixtures of such fibers and gold or silver yarns, combinations of synthetic resin shaped materials and fiber shaped materials, and surface-treated fiber materials such as water-repellent fabrics. These shaped materials can be given a thermally changeable color by the flocking treatment of the present invention.

Of the three components to be incorporated into the thermally color-changeable particulate material, examples of useful electron donating chromogenic substances are Crytal Violet lactone blue, Rhodamine lactam red, 3,3'-dimethoxyfluoran yellow, Malachite green lactone green, etc. Examples of useful electron accepting substances which are reactive with such chromogenic substances for color formation are phenols, triazoles, carboxylic acids, esters of such compounds, amides, metallic salts, etc. These two kinds of components are readily available as materials for pressure- or heat-sensitive manifold compositions. Examples of alcohols, amides, esters and azomethines useful as solvents serving as the third component and boiling at least at 150° C. are stearyl alcohol, palmityl alcohol, myristyl alcohol, lauryl alcohol, oleylamide, stearylamide, N-methyllaurylamide, acetanilide, benzamide, octyl stearate, dibutyl phthalate, benzyl benzoate, phenyl salicylate, benzylideneaniline, benzylidenestearylamine, p-methoxybenzylidene-p-anisidine, etc.

These solvents are generally termed de-sensitizing agents. With variations in temperature, the ability of these solvents to dissolve the foregoing two components varies to effect a reversible color change. More specifically, the solvent dissloves the two components at a high temperature, inhibiting color formation, whereas as lower temperatures, the dissolving ability reduces to separate out the two components, permitting them to form a color. Accordingly the solvent to be used for the method of the present invention fails to produce this effect unless it is present conjointly with the two components, so that with the present method, the three components are enclosed with a high-molecular-weight compound to form thermally color-changeable particles which assure the effect reliably and effectively.

The boiling point of the solvent should not be lower than 150° C. because solvents having a boiling point of lower than 150° C. are generally water-soluble, are difficult to encapsulate and have too low a color change temperature. For example, butyl alcohol does not permit color change at temperatures of above −80° C. and is unfit for setting a usuful color change temperature.

In contrast, the foregoing solvents which are at least 150° C. in boiling point are usable for setting the color change temperature over a substantially wide range of −40° C. to about 200° C.

Examples of high-molecular-weight compounds desirable for enclosing the three components are those having high resistance to solvents, such as polyester resin, polyamide resin, epoxy resin, urethane resin, silicone resin, melamine resin, urea resin, phenolic resin, etc. The three components can be enclosed with such a compound by any of known processes, such as the so-called microcapsulation processes including interface polymerization process, phase separation precipitation process, orifice process and in-situ process. The particles obtained should have high resistance to solvents, water and heat, be resistance to increased pressure against rupture and be uniform in size.

The thermally color-changeable particulate material for use in the present method can be prepared, for example, by the process to be described below briefly.

A mixture of 1 part by weight of electron donating chromogenic substance, 1 to 5 parts by weight of electron accepting substance and 5 to 25 parts by weight of solvent is uniformly admixed with water containing an emulsifier to obtain an emulsion. Subsequently 5 to 10 parts by weight of a mixture of butylated melamine resin solution and epoxy resin prepolymer is added to the emulsion with stirring to obtain an oily product enclosing the three components. A required amount of epoxy resin curing agent is added to the product, which is then adjusted to an acid pH value and slowly heated. The oily product is hardened by being heated at $\pi°$ to 98° C. for about 2 hours. The resulting product is filtered off, heat-treated in a dryer at 105° C. for 5 hours and then cooled, giving a tough thermally color-changeable particulate material according to the interface polymerization process.

In the above process, the particle size of the color-changeable material can be adjusted as desired by altering the stirring condition or the amount of emulsifier.

The color change temperature of the thermally color-changeable particulate material is dependent on the melting point or boiling point of the solvent used. When the solvent is low-melting, the material undergoes a color change at a lower temperature than when the solvent has a high melting point. Table 1 shows the relationship between the solvent and the color change temperature for illustrative purposes.

TABLE 1

| Solvent | Color change temperature |
|---|---|
| Benzylidenelaurylamine | 0° C. |
| Benzylidenestearylamine | 28° C. |
| Benzylidene-p-anisidine | 61° C. |
| Lauryl alcohol | 45° C. |
| Stearyl alcohol | 54° C. |
| Oleamide | 65° C. |
| Stearamide | 98° C. |

In the above examples, Crystal Violet lactone was used as the electron donating chromogenic substance, and a 1:1 mixture of bisphenol A and benzotriazole as the electron accepting substance. The color change temperature listed is such that the particulate material exhibits a color above the temperature, whereas the color disappears below the temperature.

According to the method of this invention, the thermally color-changeable particulate material is admixed with an adhesive, and the mixture is applied to a shaped material. Examples of useful adhesives are vinyl acetate resin, acrylate resin, vinyl chloride resin, ethylene-vinyl acetate copolymer resin, synthetic rubbers, urethane resins, etc. Also usable in combination with these adhesives are adhesives, such as urea resin, melamine resin and epoxy resin. According to the invention, the thermally color-changeable particulate material is admixed with a solution of such adhesives in a solvent or with an emulsion thereof to obtain a coating composition, which is used. The coating composition may further have incorporated therein chemicals which are usually used for coating, such as a viscosity adjusting agent, surfactant, antioxidant, ultraviolet absorber, plasticizer, lubricant, acid, alkali, fluorescent whitener, pigment, extender, catalyst, solvent and drying adjusting agent, without departing from the scope of the invention.

According to the present method, the adhesive layer containing the particulate material and coating the shaped material is further flocked, promptly while wet, with colored or colorless short fibers. Although not limitative, examples of useful short fibers are monofilament bundles of rayon, nylon, polyester, polyacrylic and like fibers cut to a length of 0.3 to 2.0 mm and having a diameter of 0.5 to 2.0 denier. According to the contemplated use, suitable fibers are selected from among these examples.

Although various flocking methods are usable, it is most suitable to resort to electrostatic flocking. The flocked material is dried and, when required, is heat-treated.

Thus according to the method of the invention, a shaped material of a synthetic resin or fibers can be entirely or partially flocked very effectively to give a product which has a thermally changeable color and a highly three-dimensional appearance.

EXAMPLE 1

With use of a 70-mesh screen having a polka-dotted pattern, cotton broadcloth was printed to a thickness of 0.5 mm with an adhesive ink comprising 80 parts (by weight, same as hereinafter) of MATSUMINSOL F23C (brand name, emulsion of polyacrylate copolymer resin), 2 parts of ammonia water, 5 parts of SUMITEX RESIN M-3 (brand name, melamine resin), 1 part of ammonium chloride, 10 parts of a reversibly thermally color-changeable particulate material (particles, 0.03 mm in mean size, prepared by encapsulating 3 parts of Crystal Violet lactone, 10 parts of benzotriazole and 60 parts of myristyl alcohol with 27 parts of epoxy resin, etc.) and 2 parts of GLOW YELLOW MF2G (brand name, aqueous dispersion of fluorescent pigment). Subsequently the printed layer was electrostatically flocked with short fibers (1.0 d, 0.3 mm), dried and heat-treated at 150° C. for 3 minutes. The treated cloth exhibited a vivid green color at temperatures of up to 25° C., while the color reversibly changed to brilliant yellow at 35° C. and higher temperatures. The treated cloth was satisfactory in colorfastness especially to washing and heat resistance. The garments prepared from the treated clotch had a three-dimensional appearance due to flocking, and the pattern color partially changed owing to the body temperature or ambient temperature. Thus the product has a high commercial value unlike conventional ones.

For comparison, flocked cloth was prepared in the same manner as above except that the thermally color-changeable particulate material was replaced by the three components which were not encapsulated but admixed with the adhesive component directly. The cloth exhibited a very pale color having very poor fastness to washing.

EXAMPLE 2

With use of a knife coater, a laminate sheet of polyurethane foam and polyester knitted fabric was coated over the entire surface of the foam with 150 g/m$^2$ of an adhesive coating composition comprising 75 parts of NACRYLIC 2260J (brand name, emulsion of polyacrylate copolymer resin), 3 parts of YODOSOL KA-10 (brand name, polyacrylic acid tackifier), 2 parts of ammonia water, 5 parts of MATSUMIN FIXER F (brand name, urethane crosslinking agent) and 15 parts of a reversibly thermally color-changeable particulate material [particles 0.015 mm in mean particle size and prepared by encapsulating 3 parts of YAMAMOTO RED #40 (brand name, indolyl phthalide pigment for pressure-sensitive manifold paper, product of Yamamoto Kagaku Gosei Co., Ltd.), 5 parts of bisphenol A, 2 parts of zinc benzoate, 30 parts of p-cumylbenzylidene-p-methoxyaniline, 10 parts of oleylamide and 20 parts of palmityl alcohol with 30 parts of epoxy resin and melamine resin]. The coating was then electrostatically flocked with short nylon fibers (1.5 d, 1.5 mm) colored pale turquoise blue and thereafter heat-treated at 150° C. for 5 minutes. The treated shaped material thus obtained exhibited a bluish purple color (blue flock and red inside coating) at room temperature, but the color changed to turquoise blue when the material was heated to 40° C. The color change occurred repeatedly reversibly. The material had good color-fastness to light and washing and against heat. The sheet is useful for making stuffed dolls, toy animals, etc. for infants to enjoy the color change in a bath.

What is claimed is:

1. A method of flocking treatment characterized by entirely or partially coating a surface of a shaped material of a synthetic resin or fibers with an adhesive having incorporated therein a thermally color-changeable particulate material, the particulate material comprising three components enclosed in a high-molecular-weight compound, the three components being an electron donating chromogenic substance, an electron accepting substance corresponding to the chromogenic substance and a solvent having a boiling point of at least 150° C. and selected from the group consisting of alcohols, amides, esters and azomethines; and electrostatically flocking the resulting adhesive layer with colored or colorless short fibers.

2. A material treated by the method defined in claim 1 which is useful for making stuffed toys.

* * * * *

UNITED STATES PATENT AND TRADEMARK OFFICE

CERTIFICATE OF CORRECTION

PATENT NO. : 4,560,604

DATED : December 24, 1985

INVENTOR(S) : Goro Shimizu et al

It is certified that error appears in the above-identified patent and that said Letters Patent is hereby corrected as shown below:

On the title page insert foreign application data

-- August 24, 1983 Japan 58-154384 --.

Signed and Sealed this

Tenth Day of November, 1987

*Attest:*

*Attesting Officer*

DONALD J. QUIGG

*Commissioner of Patents and Trademarks*

SR

XR 4,560,604

REEXAMINATION CERTIFICATE (996th)

United States Patent [19]

[11] B1 4,560,604

Shimizu et al.

[45] Certificate Issued Jan. 17, 1989

[54] METHOD OF FLOCKING TREATMENT

[75] Inventors: Goro Shimizu; Yosuke Kitagawa, both of Ohtsu, Japan

[73] Assignee: Matsui Shikiso Chemical Co., Ltd., Japan

Reexamination Request:
No. 90/000,975, Mar. 26, 1986

Reexamination Certificate for:

| | |
|---|---|
| Patent No.: | 4,560,604 |
| Issued: | Dec. 24, 1985 |
| Appl. No.: | 643,054 |
| Filed: | Aug. 22, 1984 |

Certificate of Correction issued Nov. 10, 1987.

[30] Foreign Application Priority Data

Aug. 24, 1983 [JP] Japan ..... 58-154384

[51] Int. Cl.[4] ..... B05D 1/06; B05D 1/14

[52] U.S. Cl. ..... 428/87; 428/90; 428/95; 428/97; 428/240; 428/245; 428/321.5; 428/913; 427/26; 427/412; 427/412.1

[58] Field of Search ..... 428/90

[56] References Cited

U.S. PATENT DOCUMENTS

| | | | |
|---|---|---|---|
| 2,324,671 | 7/1943 | Bernstein | 106/30 |
| 3,451,338 | 6/1969 | Baum | 427/148 |
| 3,490,935 | 1/1970 | Danberg | 428/90 |
| 3,539,375 | 11/1970 | Baum | 346/214 |
| 3,560,229 | 2/1971 | Farnham | 106/21 |
| 3,705,037 | 12/1972 | Inoue | 430/339 |
| 3,741,628 | 6/1973 | Margerum | 350/354 |
| 3,746,675 | 7/1973 | Blose | 524/111 |
| 3,829,401 | 8/1974 | Futaki | 346/218 |
| 3,838,033 | 9/1974 | Mindt | 204/403 |
| 3,959,434 | 5/1976 | Squier | 428/90 |
| 3,961,116 | 6/1976 | Klein | 428/90 |
| 3,979,538 | 9/1976 | Gilman | 428/90 |
| 3,993,806 | 11/1976 | Athey | 428/90 |
| 4,018,956 | 4/1977 | Casey | 428/90 |
| 4,028,118 | 6/1977 | Nakasuji et al. | |
| 4,054,684 | 10/1977 | Ceintrey | 427/145 |
| 4,086,054 | 4/1978 | Seibert | 8/527 |
| 4,205,108 | 5/1980 | Schmidt | 428/90 |
| 4,341,565 | 7/1982 | Martenson | 106/307 |
| 4,390,387 | 6/1983 | Mahn | 428/90 |
| 4,421,560 | 12/1983 | Kito | 106/21 |
| 4,425,161 | 1/1984 | Shibahashi et al. | |
| 4,501,876 | 2/1985 | Zahr | 528/232 |
| 4,502,066 | 2/1985 | Satake | 427/150 |

FOREIGN PATENT DOCUMENTS

| | | | |
|---|---|---|---|
| 1957775 | 5/1971 | Fed. Rep. of Germany | 428/90 |
| 3203059 | 8/1983 | Fed. Rep. of Germany | 427/27 |
| 33-2333 | 4/1958 | Japan | |
| 47-43048 | 10/1972 | Japan | |
| 57-51590 | 3/1982 | Japan | |
| 57-116430 | 7/1982 | Japan | |
| 1264170 | 2/1972 | United Kingdom | 427/27 |
| 1405701 | 9/1975 | United Kingdom | |
| 2093055 | 8/1982 | United Kingdom | |

OTHER PUBLICATIONS

Meldrum et al, *Qualitative Analysis, 1946, Amer. Book Co., pp. 1, 6–8, 12–15, 21–23, 27, 34–46, 62, 68–81, 84–105, 199, 201–206, 214–218, 220–223, 225–227, 229, 231–233, 236–237, 239–247, 249–252, and 255–264.*

Kolthoff et al., *Quantitative Inorganic Analysis, Rev. Ed.*, 1948, MacMillan Co., pp. 68–89, 91–124, 467, 473–475, 482, 491–499, 501–502, 504–507, 509 and 511–512.

Daniels, *Physical Chemistry*, 1948, Wiley & Sons, Inc., pp. 1–3, 5, 15–17, 25, 33, 35–40, 42–43, 58–60 and 523–561.

Glasstone, *Physical Chemistry, 2nd Ed.*, 1946, Van Nostrand Co., pp. 1, 97–100, 106–116, 479–486, 491, 494–496, 508–511, 514–517, 524–528, 535–556, 582–591, 618–619, 625, 651–662, 668, 675–683, 693, 699–700, 729, 884, 896–898, 903–904, 908, 995–997, 999, and 1039–1040.

*Primary Examiner*—Richard Bueker

[57] ABSTRACT

A method characterized by entirely or partially coating a shaped material of synthetic resin or fibers with an adhesive having incorporated therein a thermally color-changeable particulate material which comprises three components enclosed or encapsulated in a high-molecular-weight compound, the three components being an electron donating chromogenic substance, an electron accepting substance corresponding to the chromogenic substance and a solvent having a boiling point of at least 150° C. and selected from among alcohols, amides, esters and azomethines; and electrostatically flocking the adhesive layer with colored or colorless short fibers. The treated material is useful for making stuffed toys or dolls.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-2 are cancelled.

* * * * *